US006918152B2

(12) United States Patent
Fuessinger et al.

(10) Patent No.: US 6,918,152 B2
(45) Date of Patent: Jul. 19, 2005

(54) COLLAPSIBLE BRIDGE AND METHOD OF LAYING SAME

(75) Inventors: Reinhold Fuessinger, Friedrichshafen (DE); Werner Duerr, Bermatingen (DE)

(73) Assignee: Eurobridge Mobile Bruecken GmbH, Friedrichshafen (DE)

( * ) Notice: Subject to any disclaimer, the term of this patent is extended or adjusted under 35 U.S.C. 154(b) by 0 days.

(21) Appl. No.: 10/661,770

(22) Filed: Sep. 15, 2003

(65) Prior Publication Data

US 2004/0111815 A1 Jun. 17, 2004

(30) Foreign Application Priority Data

Sep. 14, 2002 (DE) ..... 102 42 836

(51) Int. Cl.[7] ..... W01D 15/12
(52) U.S. Cl. ..... 14/77.1; 14/2.4
(58) Field of Search ..... 14/77.1, 2.4, 14, 14/5, 74.5

(56) References Cited

U.S. PATENT DOCUMENTS 3,490,605 A * 1/1970 Koss ..... 212/175
4,521,932 A * 6/1985 Parramore ..... 14/2.5
4,920,595 A 5/1990 Fuessinger et al. ..... 14/2.4
4,962,556 A * 10/1990 Helmke et al. ..... 14/2.4
5,553,341 A * 9/1996 Wiedeck et al. ..... 14/2.4
5,915,423 A * 6/1999 Thomas ..... 14/2.4

FOREIGN PATENT DOCUMENTS

FR 2 758 835 7/1998

* cited by examiner

*Primary Examiner*—Thomas Will
*Assistant Examiner*—Raymond W Addie
(74) *Attorney, Agent, or Firm*—Crowell & Moring LLP

(57) ABSTRACT

A collapsible bridge and laying method for a collapsible bridge where bridge girders are pushed over an obstacle by way of a laying beam positioned in front of the obstacle to be bridged. Rollers and roller carriers carrying the rollers are fastened to the bridge girders, the rollers running in rails arranged on the laying beam. During the laying operation, the rollers with the pertaining roller carrier leaving the rail of the laying beam are removed from the bridge girder and are mounted again at a different point of the bridge girder which is momentarily situated in front of the entry into the rail of the laying beam. This process of using and removing the rollers from the bridge girder is repeated during laying of the bridge. The bridge girder can include a plurality of detachably connectible bridge girder sections.

5 Claims, 2 Drawing Sheets

COLLAPSIBLE BRIDGE AND METHOD OF LAYING SAME

BACKGROUND AND SUMMARY OF THE INVENTION

This application claims the priority of application No. 102 42 836.0-25 filed in Germany on Sep. 14, 2002, the disclosure of which is expressly incorporated by reference herein.

The invention relates to a collapsible bridge and laying method for same. Preferred embodiments relate to portable collapsible bridges for mobile use, having a laying beam pushed over an obstacle to be bridged and bridge girders with rollers which are guided by the beam during laying of the bridge with movement of the bridge girders along the laying beam.

For laying the bridge, the structures of portable bridges have to be as light as possible. Mainly in the free projection, the weight of the bridge girder to be laid considerably affects the forces to be controlled and the counterweight for the required stability and therefore, on the whole, the weight of the bridge system to be transported.

There are two principal methods of laying a girder over an obstacle (both are described in U.S. Patent Document U.S. Pat. No. 4,920,595). These methods are briefly described with their advantages and disadvantages as follow:

Method 1. Rollers at the bank (mounted on the laying beam), rail on the bridge girder:

Advantage: No roller weight during the laying of the bridge.

Disadvantage: The rail with a high roller pressure is simultaneously the high-stressed upper and lower chord during the laying and when driving on the bridge.

Method 2. Rollers on the bridge girder, rail on the bank (mounted on the laying beam).

Advantage: Highly stressed chords are not acted upon by roller pressure.

Disadvantage: The weight of the rollers also has to be laid.

It is an object of the invention to provide a laying method which has the advantages of the two known laying methods but not the disadvantages associated with these methods.

This object is achieved by a laying method for a collapsible bridge with a bridge girder, the bridge girders being pushed over an obstacle by way of a laying beam positioned in front of an obstacle to be bridged, rollers and roller carriers carrying the rollers being fastened to the bridge girder, the rollers running in rails arranged on the laying beam, wherein, during the laying operation, the rollers with the pertaining roller carrier leaving the rail of the laying beam are removed from the bridge girder and are mounted again at a different point of the bridge girder which is momentarily situated in front of the entry to the rail of the laying beam. A bridge girder suitable for the method according to the invention also achieves this object.

According to the invention, the rollers leaving the rail of the laying beams with the pertaining roller carriers are removed during the laying operation from the bridge girder being laid and are mounted again at another point of the bridge girder which is momentarily in front of the entry into the rail of the laying beam.

The invention combines the advantages of the two described laying methods according to the prior art in that the roller with their bearing structure are mounted on the girder to be laid only as long as required by the laying operation.

The bridge girders to be laid can be bridge track girders, projection girders as well as other bridge girders.

The bridge girder to be laid may be constructed particularly as a truss girder or as a deck plate girder or box girder.

Advantages of the Invention:

The invention permits the laying of a bridge girder without stressing it by additional weights (rollers as well as components for integrating the rollers into the structure of the bridge girder) which are required only for the laying operation.

The invention permits the laying of a bridge girder without stressing the chords of the girder by roller pressure.

The invention permits the implementation of a lighter, simpler and more cost-effective bridge girder because the rollers as well as their integration into the structure are eliminated.

In the free projection, the invention permits a lower counterweight for implementing the required stability. As a result, the transport weight of the system is further reduced beyond the weight reduction of the bridge girder.

Other objects, advantages and novel features of the present invention will become apparent from the following detailed description of the invention when considered in conjunction with the accompanying drawings.

DETAILED DESCRIPTION OF THE DRAWINGS

Figures 1A, 1B, 1C:
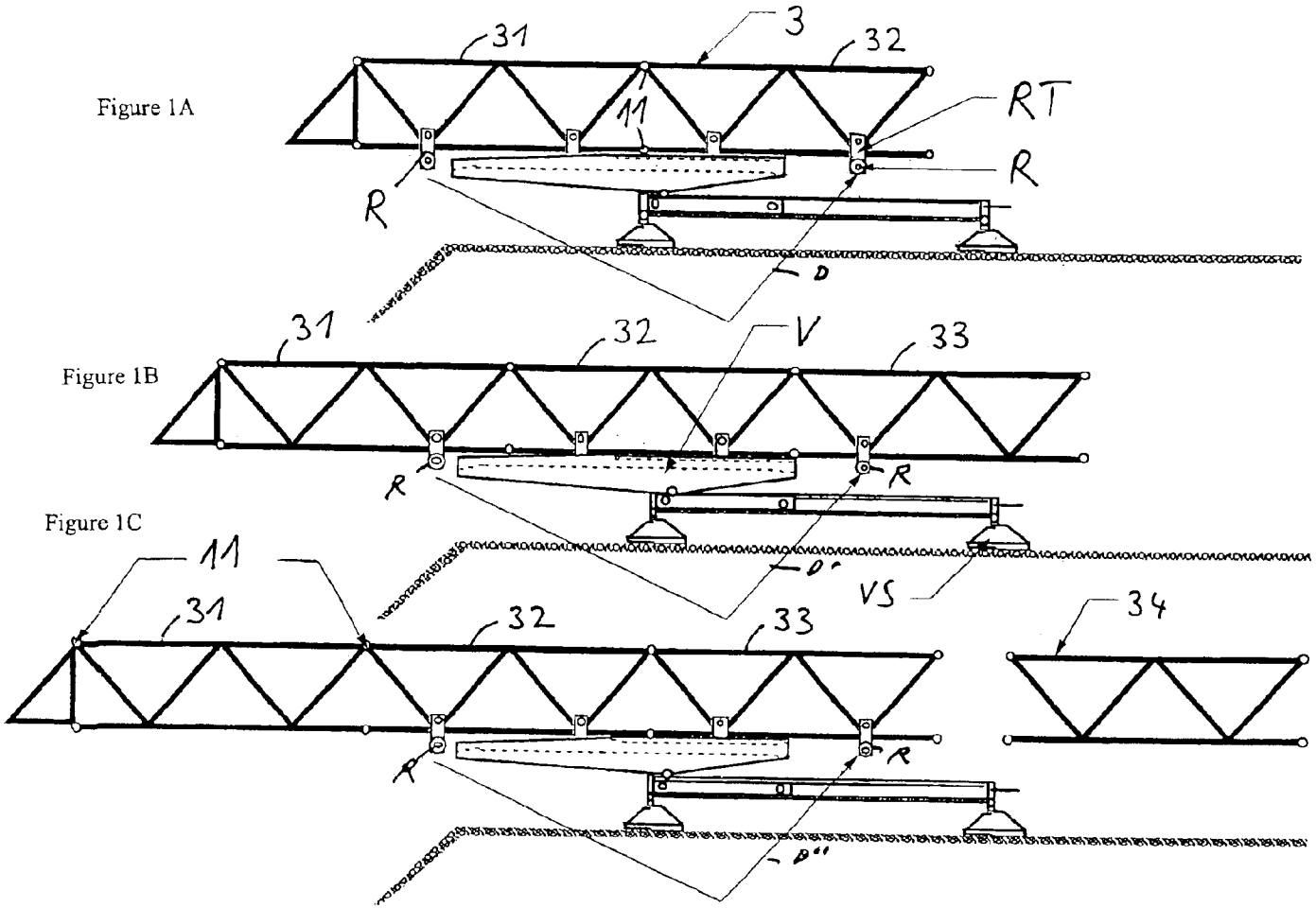
FIGS. 1A–1C are schematic views depicting the sequence of the process according to the invention in several snapshots.

FIGS. 1A–1C illustrate the sequence of the laying process on the example of a bridge track girder 3 which is constructed as a truss girder 3 having a triangular cross-section.

In front of the obstacle to be bridged, a laying beam V is positioned with a rail mounted thereon, for displacing the girder 3. Reference symbol VS indicates a support on the laying beam V.

Figure 3:
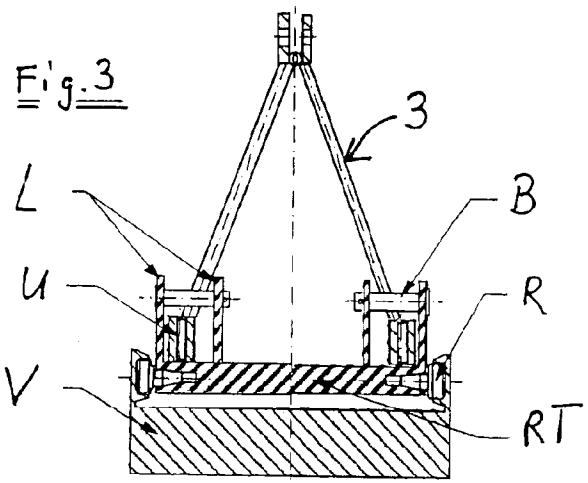
FIG. 3 is an end, part sectional view of a laying beam with a bridge girder arranged thereon, shown during the laying operation depicted in FIGS. 1A–1C.

In the FIG. 1A, two sections 31, 32 of the girder 3 are already coupled with one another (coupling points 11), and four roller carriers with pertaining rollers R (in this embodiment, each roller carrier carries precisely two rollers—see FIG. 3) are mounted in the lower nodes of the girder truss. The two center rollers are situated in the rail of the laying beam V which surrounds the rollers R in a U-shape. In this constructional condition, the forward roller R (left side of FIG. 1A), which has already left the laying beam V, is dismounted and has to be mounted on the truss node of the girder 3 behind the laying beam V as schematically depicted by the bent arrow D.

FIG. 1B shows essentially the same situation, except that here another girder section 33 was connected and the bridge girder has already been displaced one roller pitch farther over the obstacle, so that also here the roller carrier with the roller R, which has last left the laying beam V, can be dismounted and can be mounted again in the rear before the entry into the laying beam, again schematically depicted by the bent arrow D.

In FIG. 1C, this operation is repeated in the case of the bridge already displaced far over the obstacle with bent arrow D" depicting the dismount and mount of the roller R assembly. Also, a fourth girder section 34 is depicted as a next section to be assembled.

Figure 2:
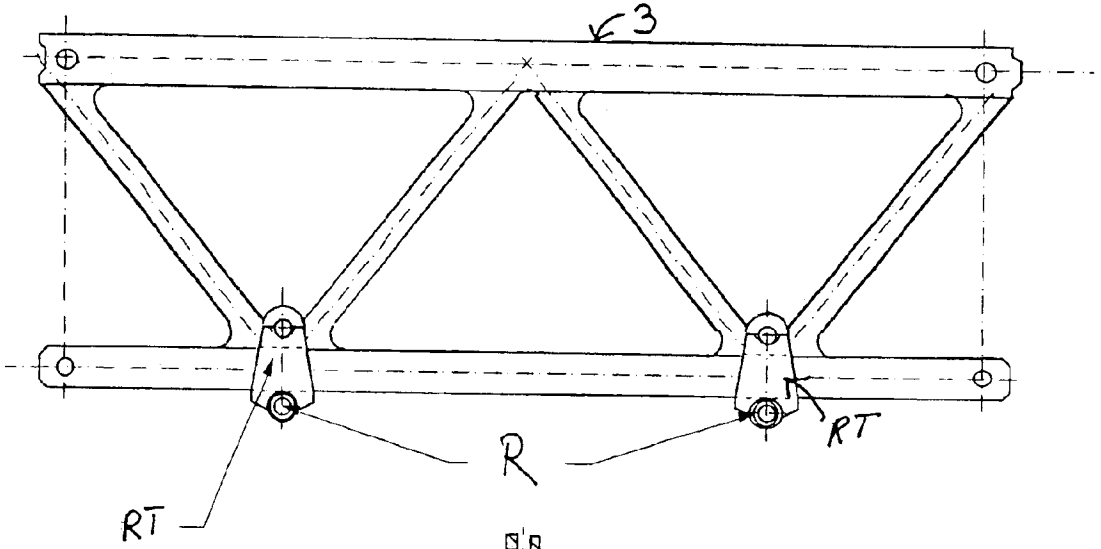
FIG. 2 is a view of a bridge girder section with rollers arranged thereon for the laying operation depicted in FIGS. 1A–1C.

The detailed outline according to FIG. 2 shows a bridge track girder 3 with two roller carriers RT with pertaining rollers R mounted in the lower truss nodes.

The sectional view according to FIG. 3 shows the roller carrier RT which surrounds the lower chord U of the bridge girder 3 and thus introduces forces in the upward direction as contact forces into the lower chord U. The lateral lugs L surround the truss node. By means of two bolts B, which are in each case fitted through the two lateral lugs L, the force connection is established for downward-directed forces which are also introduced again as contact forces directly into the truss nodes of the girder 3.

The laterally mounted rollers R are surrounded by the rail of the laying beam V which absorbs the roller forces in all directions.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for erecting a collapsible bridge girder over an obstacle comprising:

positioning a laying beam in front of an obstacle to be bridged, said laying beam having laying beam rails, pushing a bridge girder along the laying beam rails utilizing rollers and roller carriers fastened to the bridge girder with the rollers running along the laying beam rails, removing the rollers and roller carriers from the bridge girder after the rollers leave an exit end of the rails, and refastening the removed rollers and roller carriers to the bridge girder at a position of the bridge girder which is located momentarily ahead of an entry to the laying beam rails.

2. The method according to claim 1, wherein the bridge girder is formed of a plurality of bridge girder sections, and said method includes connecting the bridge girder sections together to extend the length of the girder as the bridge is laid.

3. The method according to claim 1, wherein the rollers as well as roller carriers carrying the roller are detachably fastened to an underside of the bridge girder so that they can be selectively attached and detached.

4. The method of claim 3, wherein the girder is constructed as a truss girder.

5. The method of claim 3, wherein the girder is constructed as a deck plate girder or box girder.

* * * * *